United States Patent [19]

Spillane et al.

[11] Patent Number: 4,881,383

[45] Date of Patent: Nov. 21, 1989

[54] WARP KNITTED FABRIC WITH SATIN-LIKE BACK AND BRUSHABLE FACE AND METHOD OF KNITTING SAME

[75] Inventors: Robert T. Spillane, Greensboro; Charles A. Wyrick, Gibsonville; Holger Scheller; Duval, Paul A., both of Greensboro, all of N.C.

[73] Assignee: Guilford Mills, Inc., Greensboro, N.C.

[21] Appl. No.: 215,228

[22] Filed: Jul. 5, 1988

[51] Int. Cl.[4] ..... D04B 7/12

[52] U.S. Cl. ..... 66/194

[58] Field of Search ..... 66/194

[56] References Cited

U.S. PATENT DOCUMENTS 4,567,075 1/1986 Krawczyk ..... 66/194 X

OTHER PUBLICATIONS

Reisfeld, A., "Warp Knit Fabrics and Products; Part 17", Knitted Times, Feb. 22, 1971, vol. 40, No. 8, pp. 38–48.

Darlington, K. D., "Analysis of Tricot Velour Fabrics", Knitting Times, Feb. 16, 1976, vol. 45, No. 7, pp. 34–37.

*Primary Examiner*—Ronald Feldbaum

*Attorney, Agent, or Firm*—Shefte, Pinckney & Sawyer

[57] ABSTRACT

A three-bar warp knitted fabric having a brushable pile surface at its technical face and a satin-like surface at its technical back is produced on a three-bar warp knitting machine by knitting overfed pile yarns on the machine's bottom bar to produce brushable pile loops at the fabric's technical face, knitting satin-effect yarns on the machine's middle bar in extended underlaps to produce a satin-like technical back of the fabric and knitting relative smaller denier tie-down yarns on the machine's top bar in a chain stitch pattern to also extend at the fabric's technical back in crossing relationship to the satin-effect yarn underlaps to shield them from picking without significantly obstructing their satin-like appearance.

17 Claims, 1 Drawing Sheet

WARP KNITTED FABRIC WITH SATIN-LIKE BACK AND BRUSHABLE FACE AND METHOD OF KNITTING SAME

BACKGROUND OF THE INVENTION

The present invention relates generally to wrap knitted fabrics and methods of producing such fabrics and, more particularly, to a warp knitted fabric having a satin-like technical back with a brushable pile technical face and a method of producing such fabric.

Traditionally and technically speaking, satin fabrics are produced by weaving warp and filling yarns in any of a variety of satin-weave patterns wherein the warp yarns extend in elongated floats at one fabric to predominate its surface while the filling yearns likewise extend in elongated floats at the opposite fabric face to predominate its surface. Thus, a satin provides a glossier appearance than other types of weaves and, accordingly, yearns of relatively bright lustre are commonly utilized in satin weaves to enhance this effect.

It is also possible to produce a satin-effect fabric by wrap knitting a set of lustrous warp yarns in a stitch pattern producing extended underlaps of the yarn at the technical back of the fabric. Thus, as will be understood, the extended underlaps of the yarn cause it to predominate the technical back of the fabric thereby producing a surface appearance simulative of a satin weave. As desired, another set of warp yarns may be knitted in a jersey, chain or other plain stitch pattern at the technical face of the fabric as a substrate or ground to provide structural integrity to the fabric.

Such warp knitted satin-like fabrics however suffer the disadvantage that, since the structure of knitted fabrics holds the satin-effect underlaps more loosely in the knitted fabric than in woven fabrics, the extended underlaps are highly subject to picking and snagging. Various attempts have been made in the past to overcome this problem. U.S. Pat. No. 3,027,738 disclosed one such proposal involving the use of twisted yarns to resist snagging. The effectiveness of this technique in eliminating such problem is unknown, but it is believed in any event that the use of twisted yarns would diminish the desired lustre of the satin face of the fabric. Another common technique is to knit another set of warp yarns of substantially lower denier than the satin-effect yarns at the technical back of the fabric in a chain or other plain stitch pattern to essentially tie down the underlaps to minimize their exposure to snagging and picking.

One particular form of woven satin fabric which has met with significant commercial success has a glossy satin face at one side of the fabric with the opposite side being brushed or napped to provide a plush velvet-like surface. Considerable effort has been expended in the warp knitting industry in attempts to produce a knitted fabric having both a satin-like face and an opposite brushable pile face providing comparable properties to such woven fabrics. Unfortunately, such attempts have not met with significant success. Specifically, warp knit stitch patterns which produce extended underlaps at the technical back of the fabric are unsuitable for forming a pile or plush surface at the technical face of the fabric. Attempts to incorporate a second set of overfed warp yarns in such fabrics to provide brushable or nappable pile loops at the technical face of the fabric disadvantageously tend to exacerbate the snagging problem apparently by causing the satin underlaps to become even more exposed at the fabric's technical back.

SUMMARY OF THE INVENTION

It is accordingly an object of the present invention to provide a warp knitted fabric and a method of producing such a fabric wherein one fabric side has a satin-like surface which resists snagging and the opposite fabric side has a brushable pile surface, comparable to the aforedescribed woven fabric in basic appearance and feel.

Briefly described, the warp knitted fabric of the present invention is of an at least three-bar construction having a set of pile yarns warp knitted in overfed needle loops at the technical face of the fabric forming a brushable pile surface, a set of yarns warp knitted in extended underlaps at the technical back of the fabric forming a satin-like surface, effect and a set of tie-down yarns of substantially smaller denier than the satin-effect yarns and warp knitted at the technical back of the fabric in substantially shorted underlaps than the satin-effect yarns for shielding the satin yarns from picking without significantly obstructing the satin-like appearance of the satin-effect yarns.

Preferably, the yarns are multifilament synthetic yarns with the pile and satin-effect yarns being of generally comparable denier while the tie-down yarns are of approximately one-half the denier of the satin-effect yarns. It is further preferred that the satin-effect yarns have a relatively bright surface lustre while the pile yarns have a relatively dull surface lustre. When brushed, the pile surface produces a plush surface on the technical face of the fabric. In a preferred embodiment of the fabric, the pile yarns are warp knitted in a 0,1-2,1 stitch pattern, the satin-effect yarns are warp knitted in a 1,0-3,4 stitch pattern, and the tie-down yarns are warp knitted in a 1,0-0,1 chain stitch pattern.

The present method of producing the above-described three-bar warp knitted fabric is carried out on a wrap knitting machine having at least top, middle and bottom yarn guide bars. The set of pile yarns is warp knitted on the bottom bar of the machine in overfed needle loops to appear at the technical face of the fabric forming its brushable pile surface. Simultaneously, the set of satin-effect yarns is warp knitted on the middle bar of the machine in extended underlaps to appear at the technical back of the fabric forming its satin-like surface. The set of tie-down yarns are also simultaneously warp knitted on the top bar of the machine in substantially smaller underlaps than the satin-effect yarns to appear at the technical back of the fabric and shield the satin-effect yarns from picking without obstructing their satin-like appearance.

Preferably, the brushable pile surface is brushed to produce a plush surface on the technical face of the fabric. The fabric may also be subjected to a caustic denier reduction process following knitting to improve the drapability and hand of the fabric.

DESCRIPTION OF THE PREFERRED EMBODIMENT

As explained more fully herein, the method of the present invention is carried out on a warp knitting machine which may be of any conventional type of an at least three-bar construction having three or more yarn guide bars and a needle bar, e.g., a conventional tricot warp knitting machine. The construction and operation of such machines are well known in the knitting art and need not herein be specifically described and illustrated. In the following description, the yarn guide bars of the knitting machine are identified as "top," "middle" and "bottom" guide bars for reference purposes only and not by way of limitation. As those persons skilled in the art will understand, such terms equally identify knitting machines whose guide bars may be referred to as "front," "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different set of warp yarns included in the fabric, all as is conventional terminology in the art.

Referring now to the accompanying drawings, one particular embodiment of the present warp knitted fabric of a three-bar construction knitted according to the present method on a three-bar warp knitting machine, is illustrated. According to this embodiment, the bottom guide bar of the machine is fully supplied with a set of pile yarns 10 delivered from a warp beam (not shown), while the middle yarn guide bar is fully supplied with a set of yarns 12 from another warp beam (also not shown) suitable for achieving a satin-like surface effect in the knitting fabric, as herein described, and the top guide bar is similarly fully supplied with a set of tie-down yarns 14 from a third warp beam (also not shown). Preferably, all of the yarns are multifilament synthetic yarns, e.g. polyester, with the pile and satin-effect yarns being of substantially comparable denier and filament makeup, e.g., a 40 denier, 30 filament polyester yarn, while the tie-down yarns are substantially smaller in denier and filament makeup, e.g., a 20 denier, 12 filament polyester yarn. It is further preferred that the satin-effect yarns have a relatively bright surface lustre to enhance the eventual satin-like surface appearance of the fabric as herein described, while the pile and tie-down yearns may have a relatively dull surface lustre. Of course, those persons skilled in the art will recognize that other types and sizes of yarns may also be employed as desired.

Figure 1:
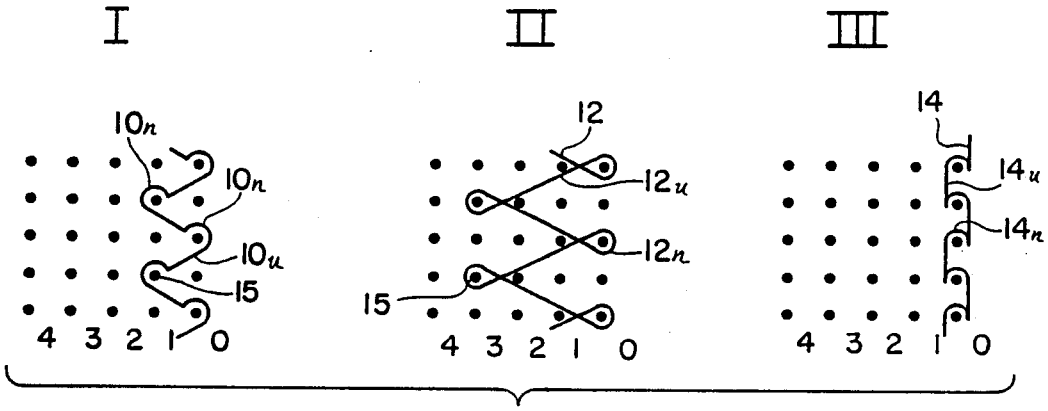
FIG. 1 is a diagram showing individually the stitch patterns for satin-effect, pile and tie-down yarns carried out by a warp knitting machine and knitting one preferred embodiment of the present fabric according to the method of the present invention
Figure 2:
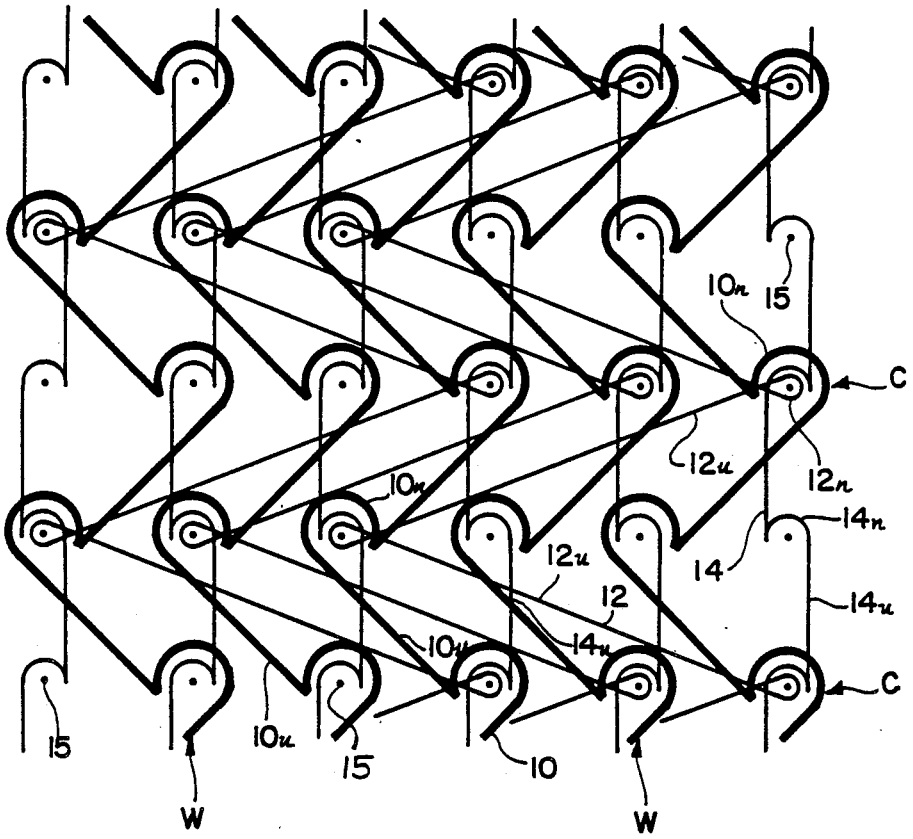
FIG. 2 is a composite point diagram thereof.

In the accompanying drawings, the stitch constructions of the pile, satin-effect and tie-down yarns 10,12,14, as carried out by the respective lateral traversing movements of the guide bars of the knitting machine according to one possible embodiment of the present fabric and method, are respectively illustrated individually and compositely in a traditional dot or point diagram format, wherein the individual points 15 represent the needles of the needle bar of the knitting machine in the formation of several successive fabric courses C across several successive fabric wales W. According to this embodiment, the bottom guide bar of the machine manipulates the pile yarns 10 to traverse laterally back and forth relative to the needles 15 of the needle bar of the machine to stitch the pile yarns 10 in a repeating 0,1-2,1 stitch pattern, as indicated at I of FIG. 1, while the pile yarns 10 are being fed from their respective warp beam in a conventional overfeeding fashion. Simultaneously, the middle guide bar of the knitting machine manipulates the satin effect yarns 12 as they are fed from their respective warp beam to traverse relative to the needles 15 to stitch the satin-effect yarns 12 in a repeating 1,0-3,4 stitch pattern, as indicated at II of FIG. 1. At the same time, the top guide bar of the machine manipulates the tie-down yarns 14 as they are fed from their respective warp beam to traverse relative to the needles 15 to stitch the tie-down yarns 14 in a repeating 1,0-0,1 chain stitch pattern, as indicated at III of FIG. 1. The respective simultaneous stitch patterns of the pile, satin-effect and tie-down yarns 10,12,14 are shown in a composite point diagram in FIG. 2.

As will thus be understood, the pile yarns 10 are interknitted with one another in the aforementioned overfed stitch construction with each pile yarn 10 being formed in needle loops $\mathbf{10}_n$ alternating ever other course C between a pair of adjacent vertical fabric wales W and in connecting underlaps $\mathbf{10}_u$ extending diagonally between the successive needle loops $\mathbf{10}_n$. The satin-effect yearns 12 are interknitted with one another and with the pile yarns 10 with each satin-effect yarn 12 being formed in needle loops $\mathbf{12}_n$ alternating every course between wales W spaced apart by two intervening wales, the satin needle loops $\mathbf{12}_n$ being interknitted in plated relationship with the needle loops $\mathbf{10}_n$ of the pile yarn 10 in the respective wales, and in elongated underlaps $\mathbf{12}_u$ extending diagonally between the successive satin needle loops $\mathbf{12}_n$ in a substantially coursewise direction. The tie-down yarns 14 are formed in respective wales W in needle loops $\mathbf{14}_n$ aligned walewise with one another and interknitted in plated relationship with the pile and satin-effect yarn needle loops $\mathbf{10}_n$,$\mathbf{12}_n$ in the respective wales and in walewise underlaps $\mathbf{14}_u$ extending in the respective wales between the successive needle loops $\mathbf{14}_n$, but the tie-down yarns 14 are not interknitted with one another due to their chain stitch construction.

As will thus be understood, the pile yarns 10 form a base or substrate to the fabric appearing substantially outwardly of the satin-effect and tie-down yarns 12,14 at the technical face of the fabric with the needle loops $\mathbf{10}_n$ of the pile yarn 10 extending generally outwardly of the fabric surface at its technical face to produce a terry-like pile fabric surface which is readily susceptible of brushing or napping to provide a plush appearance and feel to the technical face of the fabric. The satin-effect yarns 12 appear outwardly of the pile yarns 10 at the technical back of the fabric with the extended underlaps $\mathbf{12}_u$ of the satin-effect yarn 12 substantially obscuring the underlaps $\mathbf{10}_u$ of the pile yarn 10 at the fabric's technical back to present a satin-like fabric surface. The tie-down yarns 14 appear outwardly of the satin-effect yarns 12 at the technical back of the fabric but, due to their chain stitch construction and their smaller denier, the visibility of the tie-down yarns 14 at the technical back of the fabric is minimal in comparison to the satin-effect yarn underlaps $\mathbf{12}_u$ so that the tie-down yarns 14 therefore do not significantly obstruct or impair the satin-like appearance of the satin effect yarns 14. On the other hand, the chain stitch construction of the tie-down yarns 14 causes their underlaps $\mathbf{14}_u$ to extend substantially walewise in outwardly crossing relationship to the satin-effect yarn underlaps $\mathbf{12}_u$ whereby the tie-down yarns function to prevent undesirable outward extension of the satin yarn underlaps $12_u$ from the surface of the fabric's technical back to shield the satin yarn underlaps $12_u$ from picking and snagging.

Following the knitting of the present warp knitted fabric according to the method as described, it is preferred that the brushable pile surface at the technical face of the fabric be subjected to a brushing, sanding, napping or similar operation to produce a raised velvet-like plush surface effect at the technical face of the fabric. Additionally, to the extend necessary or desirable, the knitted fabric may be subjected to a caustic denier reduction processing as a finishing step following removal of the knitted fabric from the warp knitting machine, in order to enhance the hand and drapability characteristics of the fabric.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A warp knitted fabric of an at least three-bar construction characterized by a brushable surface on the technical face of said fabric and a satin-like surface on the technical back of said fabric, said fabric comprising a set of pile yarns warp knitted in overfed needle loops at the technical face of said fabric forming a brushable pile surface, a set of yarns warp knitted in extended underlaps at the technical back of said fabric forming a satin-like surface effect, and a set of tie-down yarns of substantially smaller denier than said satin yarns and warp knitted at the technical back of said fabric in substantially shorter underlaps than said satin-effect yarns for shielding said satin-effect yarns from picking without significantly obstructing the satin-like appearance of said satin-effect yarns.

2. A warp knitted fabric according to claim 1 and characterized further in that said brushable pile surface is brushed to produce a plush surface on the technical face of said fabric.

3. A warp knitted fabric according to claim 1 and characterized further in that said tie-down yarns are warp knitted in a chain stitch pattern.

4. A warp knitted fabric according to claim 1 and characterized further in that said satin-effect yarns have a relatively bright surface lustre and said pile yarns have a relatively dull surface lustre.

5. A warp knitted fabric according to claim 1 and characterized further in that said satin-effect and pile yarns are of generally comparable denier.

6. A warp knitted fabric according to claim 1 and characterized further in that said satin-effect and pile yarns are multifilament synthetic yarns.

7. A warp knitted fabric according to claim 1 and characterized further in that said tie-down yarns are of approximately one-half the denier of said satin-effect yarns.

8. A warp knitted fabric according to claim 1 and characterized further in that said pile yarns are warp knitted in a 0,1-2,1 stitch pattern, said satin-effect yarns are warp knitted in a 1,0-3,4 stitch pattern, and said tie-down yarns are warp knitted in a 1,0-0,1 chain stitch pattern.

9. A method of producing a warp knitted fabric of at least three-bar construction having a brushable surface on the technical face of said fabric and a satin-like surface on the technical back of said fabric, said method comprising:

providing a warp knitting machine having at least top, middle and bottom yarn guidebars;

warp knitting a set a pile yarns on said bottom bar of said machine inn overfed needle loops at the technical face of said fabric forming a brushable pile surface;

simultaneously warp knitting a set of yarns on said middle bar of said machine in extended underlaps at the technical back of said fabric forming a satin-like surface effect; and simultaneously warp knitting on said top bar of said machine a set of tie-down yarns of substantially smaller denier than said satin-effect yarns in substantially smaller underlaps than said satin-effect yarns at the technical back of said fabric;

said tie-down yarns shielding said satin-effect yarns from picking without significantly obstructing the satin-like appearance of said satin-effect yarns.

10. A method of producing a warp knitted fabric according to claim 9 and characterized further by brushing said brushable pile surface to produce a plush surface on the technical face of said fabric.

11. A method of producing a warp knitted fabric according to claim 9 and characterized further by warp knitting said tie-down yarns in a chain stitch pattern.

12. A method of producing a warp knitted fabric according to claim 9 and characterized further by providing yarns having a relatively bright surface lustre as said satin-effect yarns and providing yarns having a relatively dull surface lustre as said pile yarns.

13. A method of producing a warp knitted fabric according to claim 9 and characterized further by providing yarns of generally comparable denier as said satin-effect and pile yarns.

14. A method of producing a warp knitted fabric according to claim 9 and characterized further by providing multifilament synthetic yarns as said satin-effect and pile yarns.

15. A method of producing a warp knitted fabric according to claim 9 and characterized further by providing yarns having approximately one-half the denier of said satin-effect yarns as said tie-down yarns.

16. A method of producing a warp knitted fabric according to claim 9 and characterized further by warp knitting said pile yarns in a 0,1-2,1 stitch pattern, warp knitting said satin-effect yarns in a 1,0-3,4 stitch pattern, and warp knitting said tie-down yarns in a 1,0-0,1 chain stitch pattern.

17. A method of producing a warp knitted fabric according to claim 9 and characterized further by performing a caustic denier reduction process on said fabric following knitting to improve the drapability and hand of said fabric.

* * * * *

UNITED STATES PATENT AND TRADEMARK OFFICE

CERTIFICATE OF CORRECTION

PATENT NO. : 4,881,383

DATED : November 21, 1989

INVENTOR(S) : Robert T. Spillane et al

It is certified that error appears in the above-identified patent and that said Letters Patent is hereby corrected as shown below:

Column 1, Line 7, reads "wrap" but should read -- warp --.

Column 1, Line 15, after "fabric" add -- face --.

Column 1, Line 16, reads "yearns" but should read -- yarns --.

Column 1, Line 18, after "satin" add -- weave --.

Column 1, Line 20, reads "yearns" but should read -- yarns --.

Column 1, Line 23, reads "wrap" but should read -- warp --.

Column 1, Line 40, reads "disclosed" but should read -- discloses --.

Column 2, Line 19, reads "satin-like surface, effect" but should read -- satin-like surface effect, --.

Column 2, Line 22, reads "shorted" but should read -- shorter --.

Column 2, Line 23, reads "satin yarns" but should read -- satin-effect yarns --.

Column 2, Line 35, reads "0,1-2,1" (boldface type) but should read -- 0,1-2,1 -- (nonboldface type).

Column 2, Line 41, reads "wrap" but should read -- warp --.

Column 2, Line 64, after "for" add -- the --.

Column 2, Line 67, after "invention" add -- , --.

Column 3, Line 24, reads "set" but should read -- sets --.

UNITED STATES PATENT AND TRADEMARK OFFICE

CERTIFICATE OF CORRECTION

PATENT NO. : 4,881,383

DATED : November 21, 1989

INVENTOR(S) : Robert T. Spillane et al

It is certified that error appears in the above-identified patent and that said Letters Patent is hereby corrected as shown below:

Column 3, Line 37, reads "knitting" but should read -- knitted --.

Column 3, Line 41, after "e.g." add -- , --.

Column 3, Line 50, reads "yearns" but should read -- yarns --.

Column 4, Line 5, reads "satin effect" but should read -- satin-effect --.

Column 4, Line 20, reads "ever" but should read -- every --.

Column 4, Line 24, reads "yearns" but should read -- yarns --.

Column 4, line 28, 32, before "needle" delete --satin--.

Column 4, Line 63, reads "satin effect" but should read -- satin-effect --.

Column 5, Line 1, reads "satin yarn" but should read -- satin-effect yarn --.

Column 5, Lines 2-3, reads "satin yarn" but should read -- satin-effect yarn --.

Column 5, Line 10, reads "extend" but should read -- extent --.

Column 5, Line 46, reads "satin yarns" but should read -- satin-effect yarns --.

UNITED STATES PATENT AND TRADEMARK OFFICE

CERTIFICATE OF CORRECTION

PATENT NO. : 4,881,383

DATED : November 21, 1989

INVENTOR(S) : Robert T. Spillane et al

It is certified that error appears in the above-identified patent and that said Letters Patent is hereby corrected as shown below:

Column 6, Line 18, reads "a set a pile yarns" but should read -- a set of pile yarns --.

Column 6, Line 19, reads "inn" but should read -- in --.

Signed and Sealed this

Twenty-second Day of December, 1992

*Attest:*

DOUGLAS B. COMER

*Attesting Officer*

*Acting Commissioner of Patents and Trademarks*